US008967377B2

(12) United States Patent
Lebauer

(10) Patent No.: US 8,967,377 B2
(45) Date of Patent: Mar. 3, 2015

(54) PROTECTIVE CASE FOR PORTABLE ELECTRONIC DEVICE WITH FOLDABLE LENS COVER AND STORAGE COMPARTMENTS

(71) Applicant: Ian F Lebauer, Maple Lake, MN (US)

(72) Inventor: Ian F Lebauer, Maple Lake, MN (US)

( * ) Notice: Subject to any disclaimer, the term of this patent is extended or adjusted under 35 U.S.C. 154(b) by 0 days.

(21) Appl. No.: 13/762,269

(22) Filed: Feb. 7, 2013

(65) Prior Publication Data

US 2013/0199948 A1 Aug. 8, 2013

Related U.S. Application Data

(60) Provisional application No. 61/595,751, filed on Feb. 7, 2012.

(51) Int. Cl.

| | |
|---|---|
| ***B65D 81/02*** | (2006.01) |
| ***A45C 11/00*** | (2006.01) |
| ***A45C 11/34*** | (2006.01) |
| ***A45C 15/00*** | (2006.01) |

(52) U.S. Cl.

CPC ..... *B65D 81/02* (2013.01); *A45C 11/00* (2013.01); *A45C 11/008* (2013.01); *A45C 11/34* (2013.01); *A45C 15/00* (2013.01); *A45C 2011/002* (2013.01); *A45C 2011/007* (2013.01)

USPC ..... 206/320; 206/576

(58) Field of Classification Search

USPC ..... 206/320, 576, 234, 235, 216, 38

See application file for complete search history.

(56) References Cited

U.S. PATENT DOCUMENTS

| | | | | |
|---|---|---|---|---|
| 4,874,103 | A * | 10/1989 | Quisenberry et al. | 220/254.3 |
| 5,211,458 | A * | 5/1993 | Yale | 312/193 |
| D414,925 | S * | 10/1999 | Holland | D3/218 |
| 6,788,919 | B2 * | 9/2004 | Watanabe | 455/90.3 |
| 7,431,161 | B2 * | 10/2008 | Carlino | 206/581 |
| 7,609,512 | B2 * | 10/2009 | Richardson et al. | 361/679.41 |
| 8,047,364 | B2 * | 11/2011 | Longinotti-Buitoni | 206/320 |
| D651,201 | S * | 12/2011 | Fathollahi | D14/250 |
| 8,251,210 | B2 * | 8/2012 | Schmidt et al. | 206/320 |
| D667,823 | S * | 9/2012 | Merenda | D14/250 |
| D688,654 | S * | 8/2013 | Stevinson | D14/250 |
| D688,655 | S * | 8/2013 | Rey-Hipolito et al. | D14/250 |
| 8,499,933 | B2 * | 8/2013 | Ziemba | 206/320 |
| 2007/0223183 | A1 * | 9/2007 | Oja | 361/681 |
| 2009/0166247 | A1 * | 7/2009 | Gindi | 206/581 |
| 2010/0147710 | A1 * | 6/2010 | Lebauer | 206/234 |
| 2010/0183814 | A1 * | 7/2010 | Rios et al. | 427/387 |
| 2010/0224519 | A1 * | 9/2010 | Kao | 206/320 |
| 2010/0230301 | A1 * | 9/2010 | Fellig | 206/232 |
| 2011/0203956 | A1 * | 8/2011 | Deutchman | 206/320 |
| 2012/0112031 | A1 * | 5/2012 | Gormick et al. | 248/371 |

* cited by examiner

*Primary Examiner* — Steven A. Reynolds
(74) *Attorney, Agent, or Firm* — Beck & Tysver PLLC

(57) ABSTRACT

A protective case for a portable electronic device. The protective case including a plurality of storage compartments for retaining a series of items. The protective case includes a removable upper portion allowing unobstructed access to the portable electronic device camera and includes a plurality of corner accessories disposed within and forming the corners of the protective case.

12 Claims, 9 Drawing Sheets

PROTECTIVE CASE FOR PORTABLE ELECTRONIC DEVICE WITH FOLDABLE LENS COVER AND STORAGE COMPARTMENTS

CROSS REFERENCE TO RELATED APPLICATIONS

This application claims the benefit of provisional patent application Ser. No. 61/595,751, filed 2012 Feb. 7 by the present inventor.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The present invention relates to an improved protective case for a portable electronic device.

As the value of and function of portable electronic devices has increased, individuals have desired to protect their electronic devices using a protective case. Most portable electronic devices in use today include a camera. Cases designed to provide protection for portable electronic devices often leave the camera lens and flash fully exposed, allowing such exposed camera elements to be soiled and scratched.

Therefore, a protective case is needed that has the ability to protect the camera and camera components. Preferably this case includes additional storage compartments allowing a user the ability to maintain within the case essential everyday or desired items.

SUMMARY OF THE INVENTION

In a protective case for a portable electronic device embodying the principles of the invention, the protective case includes a plurality of storage compartments to contain various everyday and essential items preferably with a lens cover removably attached to the protective case. Alternatively, the lens cover is hingeably attached to the protective case, so that it can be folded flat against the rest of the protective case when the device's camera is in use. Removing the lens cover or folding the lens cover open allows the camera to be operated so that it is completely unobstructed by the lens cover.

The storage compartments composed within a back cover of the device are preferably provided with fixed dimensions to allow for the storage of specifically designed items to be retained within the storage compartments. These compartments of set sizes allow a user to transfer these specifically designed items across multiple protective cases with storage compartments of set sizes used on various personal electronic devices. Further, a plurality of corner accessories may be disposed within the corners of the protective case.

BRIEF DESCRIPTION OF THE SEVERAL VIEWS OF THE DRAWING(S)

The accompanying drawings are included to provide a further understanding of the present invention and are incorporated in and constitute a part of this specification. The drawings illustrate exemplary embodiments of the present invention and together with the description serve to further explain the principles of the invention. Other aspects of the invention and the advantages of the invention will be better appreciated as they become better understood by reference to the Detailed Description when considered in conjunction with accompanying drawings, and wherein.

DETAILED DESCRIPTION OF THE INVENTION

Figure 1:
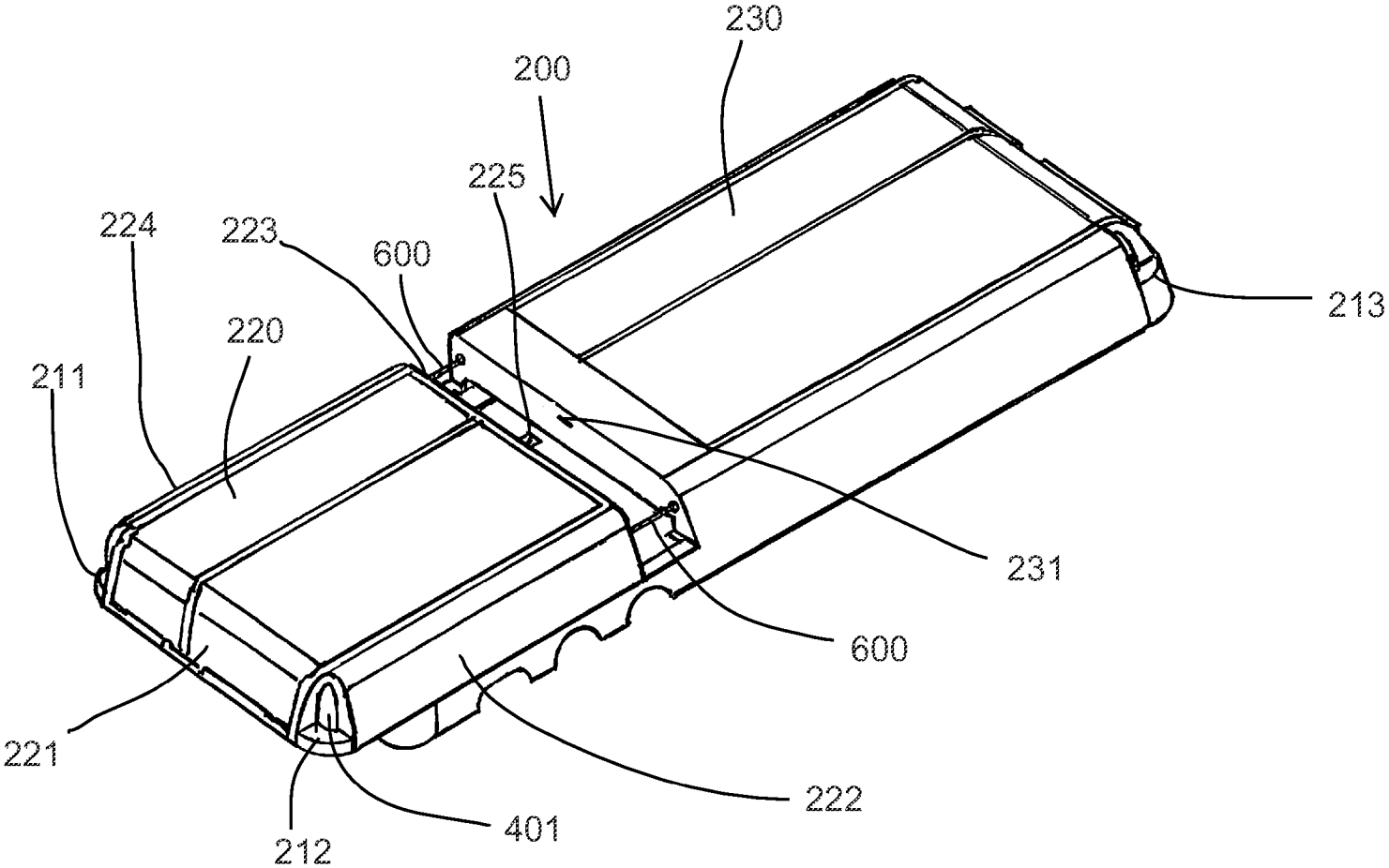
FIG. 1 is an isometric view of a back portion of a protective case for a personal electronic device, according to the present invention.
Figure 2:
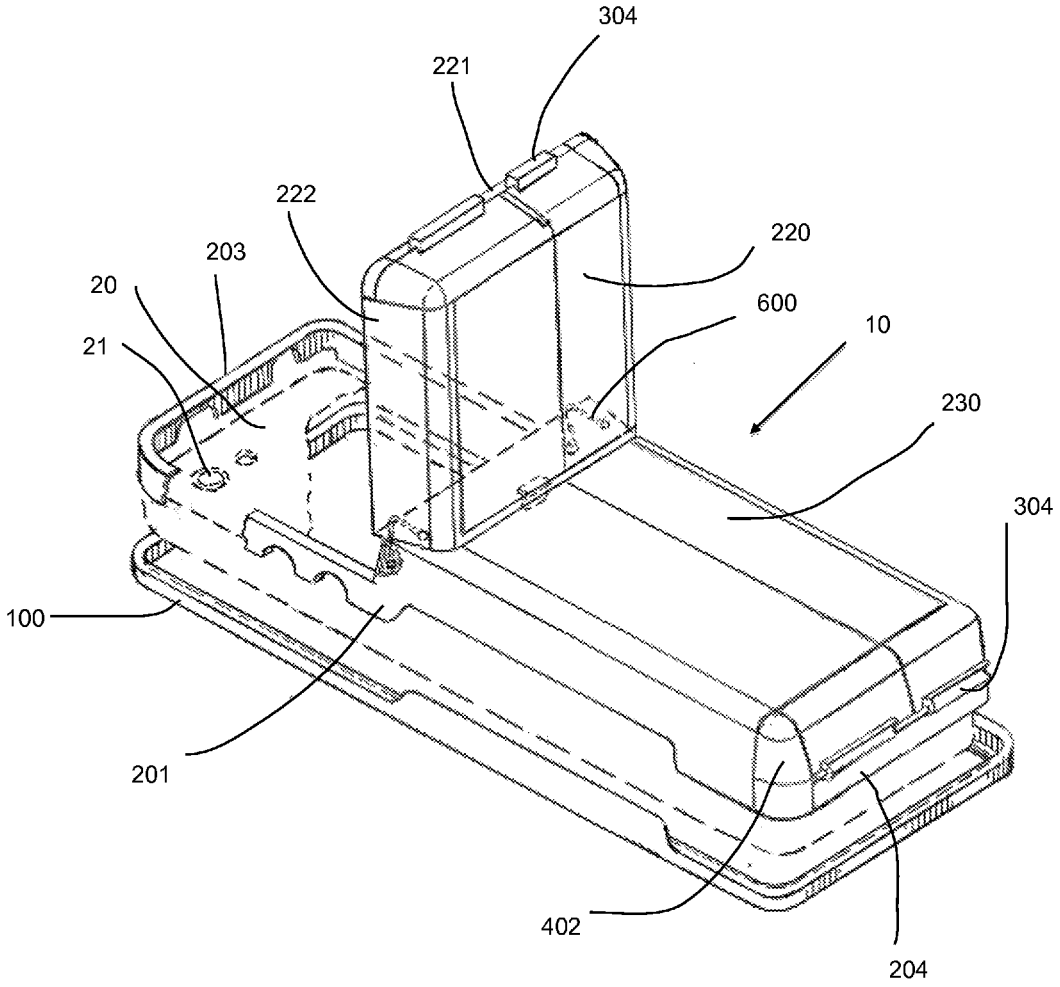
FIG. 2 is an isometric view of the protective case with the upper part partially removed, according to the present invention.

Referring now to FIGS. 1-9, a protective case 10 for a portable electronic device 20 is disclosed. The protective case 10 is comprised of a front portion 100, a back portion 200, a left side portion 201, a right side portion 202, a top end portion 203, and a bottom end portion 204 encapsulating the portable electronic device 20. The front portion 100 enclosing the front edges of the portable electronic device 20 and allowing a user of the device 20 access to the display and user input areas of the portable electronic device 20.

The back portion 200 encloses the back of the portable electronic device 20. The left side portion 201 and the right side portion 202 partially enclose the left and right sides of the portable electronic device 20. The top end portion 203 and the bottom end portion 204 partially enclose the top end and the bottom end of the portable electronic device 20. The left side portion 201, the right side portion 202, the top end portion 203, and the bottom end portion 204 extend between the back potion 200 and the front portion 100 attaching the front portion 100 to the back portion 200. The left side portion 201, the right side portion 202, the top end portion 203, and the bottom end portion 204 allow access to all of the necessary components of the portable electronic device 20, such as the volume buttons, accessory attachment points, input ports, power buttons, and headphone jacks, etc.

A first corner 211 is located at the junction of the top end portion 203 and the right side portion 202. A second corner 212 is located at the junction of the top end portion 203 and the left side portion 201. A third corner 213 is located at the junction of the bottom end portion 204 and the left side portion 201. A fourth corner 214 is located at the junction of the bottom end portion 204 and the right side portion 202. The first corner 211, the second corner 212, the third corner 213, and the fourth corner 214 allow access to a corner storage compartment 401 forming a cavity in the protective case 10. The corner storage compartment 401 allows for the storage of a corner accessory 400 within the protective case 10.

The corner accessory 400 is integrated into at least one of the first corner 211, the second corner 212, the third corner 213, and the fourth corner 214. The corner accessory 400 is comprised of a head 402 and a body 403. The head 402 conforms to the outer corner of the portable case 10 and allows the corner accessory 400 to be removed or replaced within the protective case 10. The body 403 extends a length. Preferably the body length is between 1 mm and 300 mm. The corner accessory 400 includes but is not limited to, a toothpick 405, a tweezers 406, a screen-cleaning device 407, a kickstand 408, a writing implement 409, a stylus 410, a screwdriver, and a cosmetic applicator.

The back portion 200 includes at least one storage compartment 301. The storage compartment 301 is disposed and integrated within the back portion 200. The storage compartment 301 includes a cover 302. Preferably, the cover 302 is secured to the back portion 200 with a hinge 304. Preferably, the hinge 304 is located at the periphery of the back portion 200 and located along the protective case 10 sides or ends. In the preferred embodiment of the present invention, the back portion 200 includes a plurality of storage compartments 301 that are rectangular in shape and provided in fixed sizes arranged to fit within the case 10.

Fixed rectangular sizes are preferred as it allows for the utilization of several specially designed items 500 for placement within the storage compartments 301. Fixed compartment sizes allow these items 500 to be used across multiple protective cases 10 secured to varying devices 20 or transferred to a new protective case 10 when a user has obtained a new personal electronic device 20. Accordingly, a user has the ability to retain and grow a collection of items 500 for securing within the storage compartments 301.

The items 500 including, but not limited to, a tool, a tweezers, a toothpick, a lens cleaning cloth, a kickstand, a set of earphones, a telephonic head/speaker set, a flash drive, a laser pointer, a health monitoring item, a medical item, an office product, a cosmetic product, a pharmaceutical product, a candy product, a hygiene product, a spice, a sweetener, a condiment, a cleaning product, a writing instrument, an adhesive product, a mount, a safety product, a first aid product, a survival product, a oral care product, a pair of eye glasses, and a electronic component, such as batteries, chargers, and cables.

As the items 500 come in varying shapes, sizes, and thicknesses, a removable storage compartment mat 303 is preferably used to frictionally secure the item 500 within the storage compartment 301. Preferably, the storage compartment mat 303 is provided along with the item 500 for securing the item 500 within the storage compartment 301. The thickness of the storage compartment mat 303 is determined utilizing the depth of the storage compartment 301 less the thickness of the item 500. The storage compartment mat 303 can be composed varying materials such as foam, rubber, silicone rubber, or other similar materials that offer both cushioning and frictional resistance. Preferably, this material is tacky on a top surface, a bottom surface, or both the top and bottom surface to allow for the retention of the items 500 within the storage compartment 301 and to allow for the retention of the mat 303 itself with the storage compartment 301. Further, it is preferred that the mat 303 be compressible to allow for variations in the size items 500 and to offer a cushioned element to protect and secure the items 500 received with the storage compartment 301.

There are numerous dimensions available for the fixed dimensions of the storage compartment 301 that can be arranged to fit within the size of the protective case 10. It is desired to maximize the number and size of the storage compartments 301 while ensuring that the size of the storage compartments 301 is suitable for the various the items 500 that can be retained with the storage compartments 301. Three different storage compartment 301 widths with one of two lengths and a common depth has proven to be a desirable solution.

The preferred dimensional depth range of the storage compartment 301 is between 1 mm and 60 mm with the preferred depth being 6 mm. This is the preferred depth as it maximizes storage while still allowing the protective case 10 to maintain a slim profile and be retained within a pocket or purse. The preferred dimensional range of the width of the storage compartment 301 is between 1 mm and 300 mm, with the preferred width being three separate compartments having a width of 10 mm, 15 mm, and 30 mm. The preferred dimensional range of length of the storage compartment 301 is between 1 mm and 300 mm, with the preferred length being 40 mm and 60 mm. According to the preferred ranges and dimensions, it is preferred that six unique sizes of storage compartments 301 are arranged to fit within the various dimensions of the protective case 10 secured to various personal electronic devices 20. These preferred six dimensions are: a depth of 6 mm, a width of 10 mm, and a length of 40 mm; a depth of 6 mm, a width of 15 mm, and a length of 40 mm; a depth of 6 mm, a width of 30 mm, and a length of 40 mm; a depth of 6 mm, a width of 10 mm, and a length of 60 mm; a depth of 6 mm, a width of 15 mm, and a length of 60 mm; and a depth of 6 mm, a width of 30 mm, and a length of 60 mm.

Different combinations of the storage compartment 301 dimensions are chosen based upon the overall length and width of the protective case 10 for a given personal electronic device 20. The majority of the storage compartments 301 extend vertically along the longitudinal axis of the generally rectangular protective case 10, thereby maximizing space. However, the storage compartments 301 can also be positioned horizontally along the longitudinal axis of the generally rectangular protective case 20.

As most personal electronic devices 20 include a camera lens and camera components 21 disposed on the back of the device 20, the protective case 10 may include a removable lens cover. Camera components 21 can include speakers, microphones, lenses, and other recording means for capturing sound and video. Preferably, the removable lens cover is comprised of a removable upper part 220 of the back portion 200. The upper part 220 is defined at its periphery by a top edge 221, a left edge 222, a bottom edge 223, a right edge 224, and a floor 227. The upper part 220 is removably affixed to a lower part 230 of the back portion 200 by a securing means. The securing means may be a clip, pin, snap, detent or other similar securing means. Preferably the securing means is at least one tab 225 with a raised detent 226 affixed to the bottom edge 223 for receipt within a slot(s) 231 present in a sidewall of the lower back portion 230. A pair of tabs 225 located at the outer periphery of the bottom edge 223 and received within a pair of corresponding slots 231 is preferred.

Figure 3:
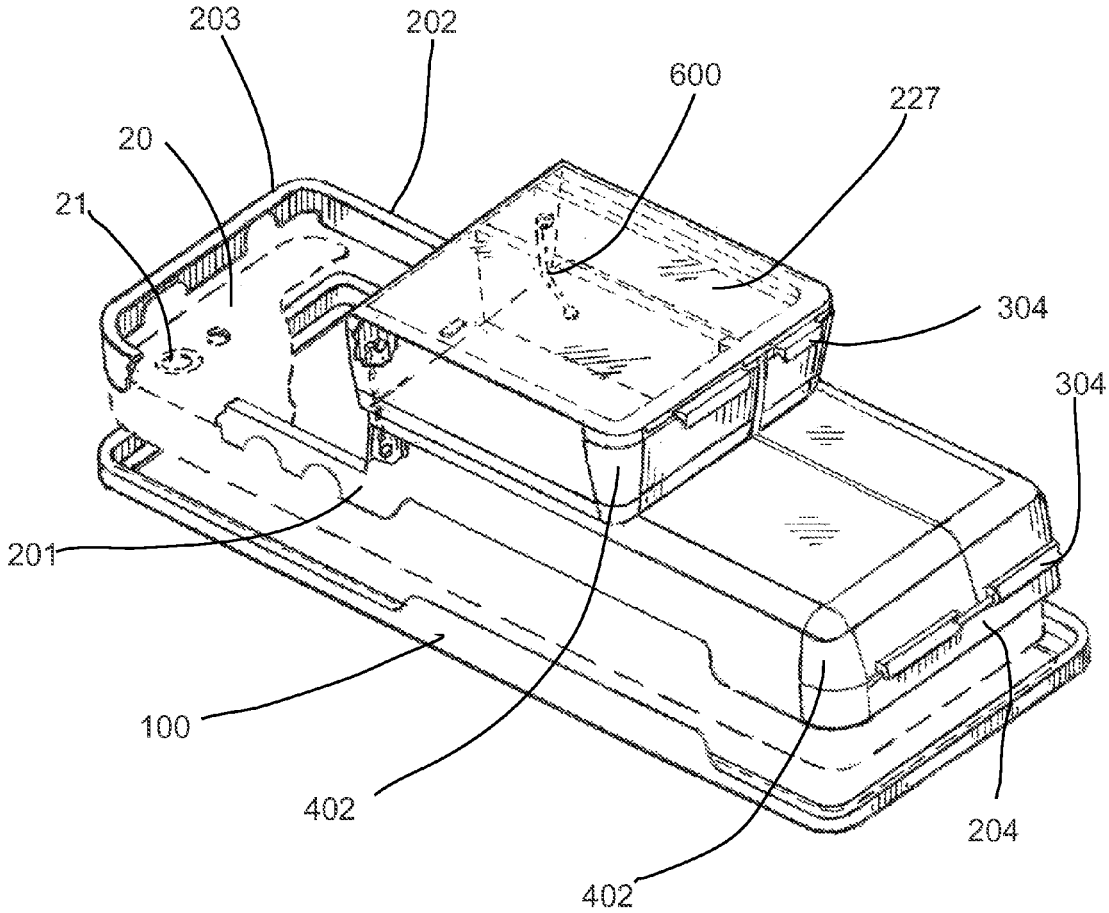
FIG. 3 is an isometric view of the protective case with the upper part fully removed, according to the present invention.
Figure 4:
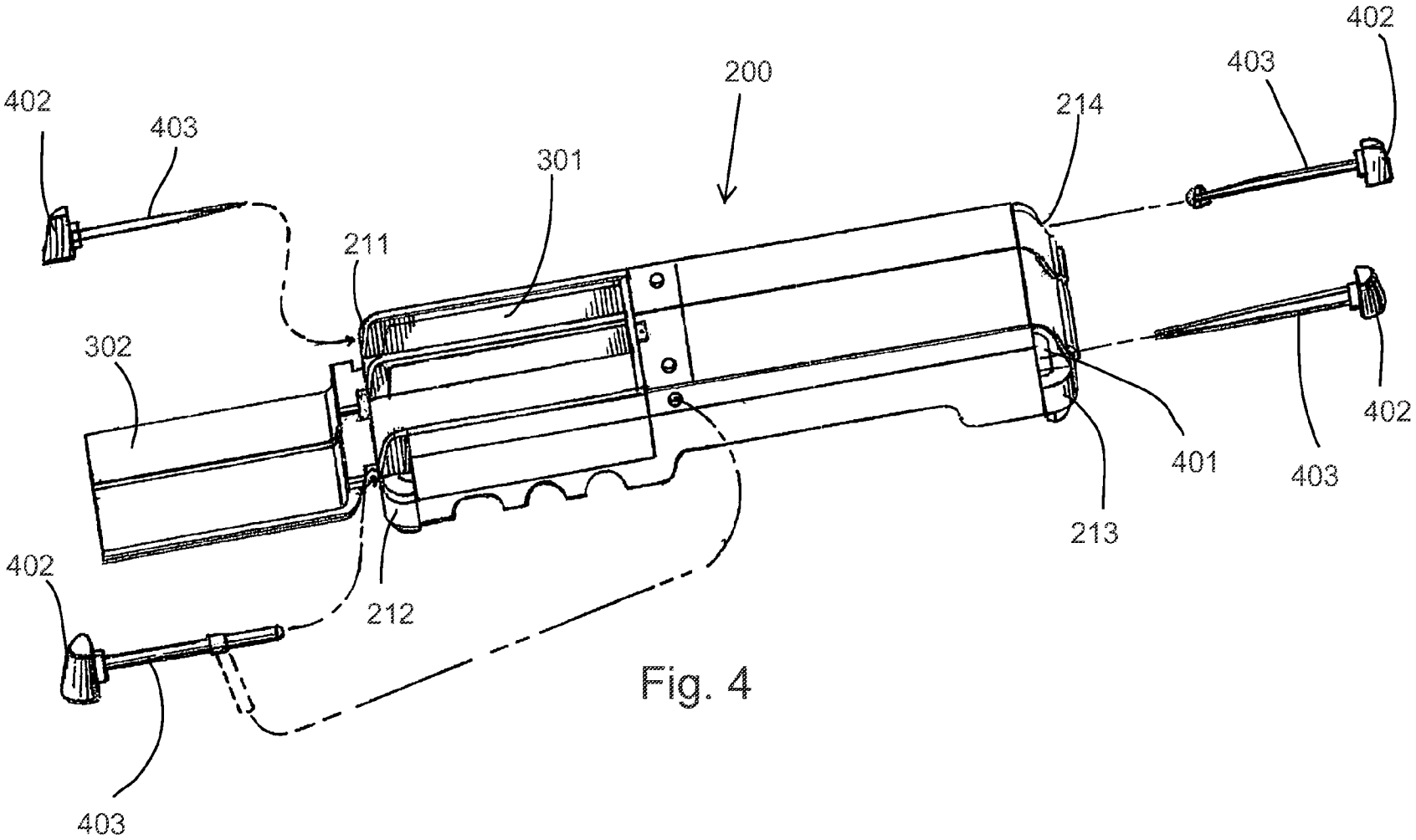
FIG. 4 is an isometric view of the back portion of the protective case with corner accessories, according to the present invention.
Figure 5:
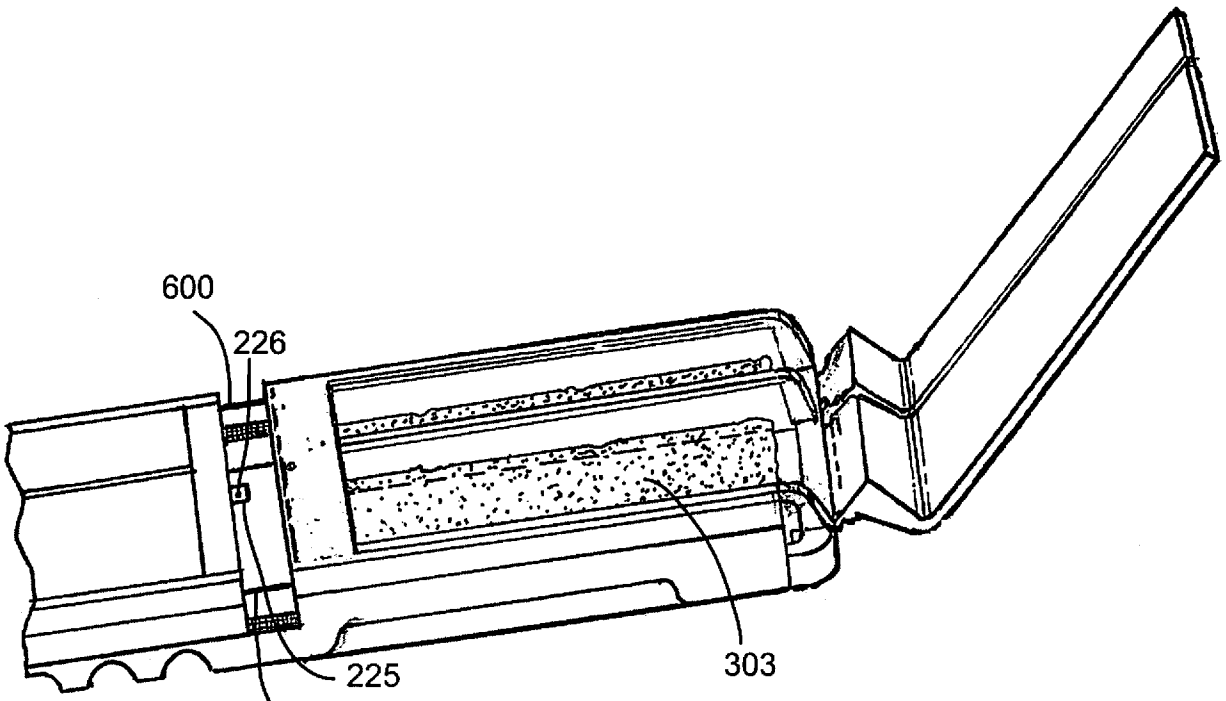
FIG. 5 is an isometric view of the back portion of the protective case with storage compartment open and upper portion partially removed, according to the present invention.
Figure 6:
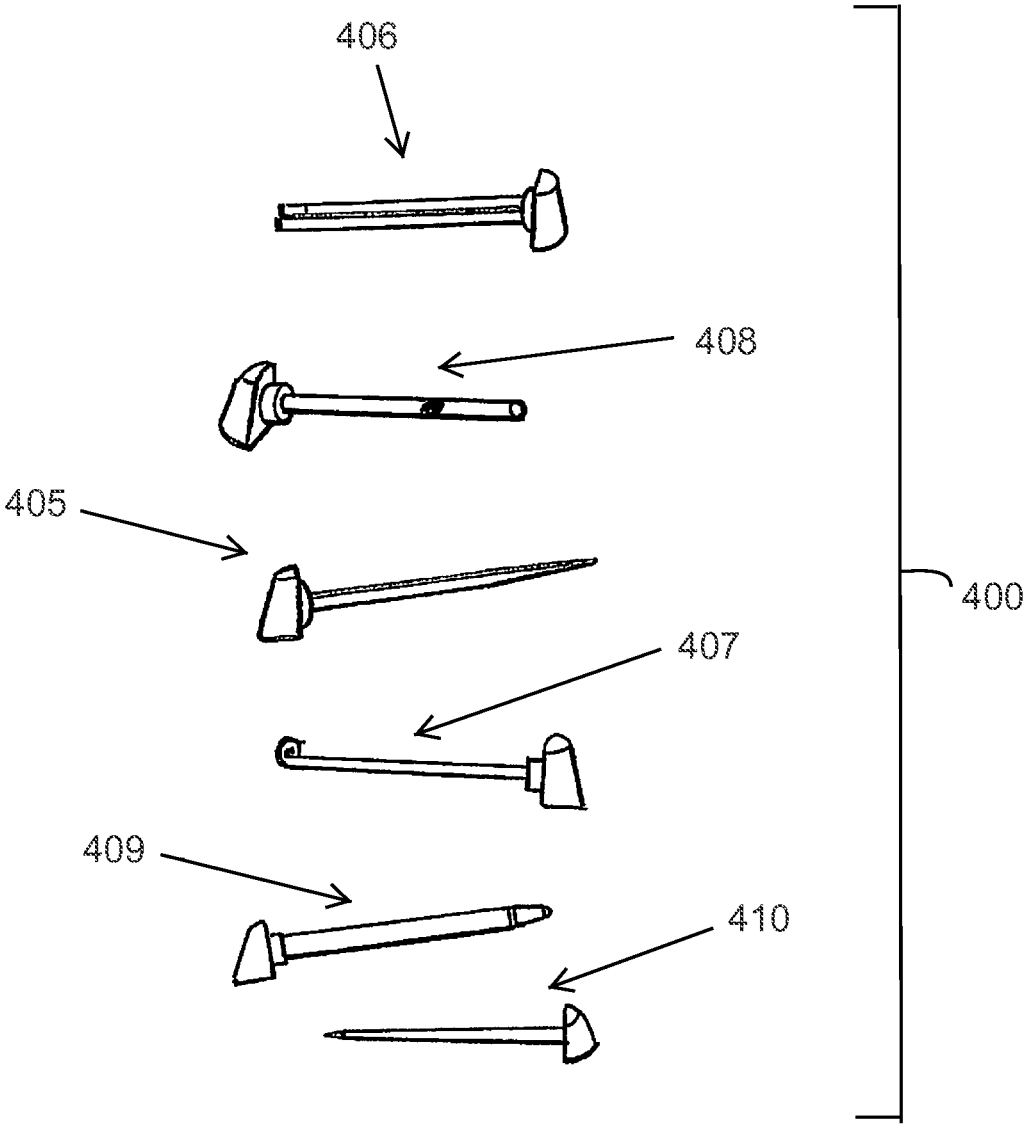
FIG. 6 is an isometric view of the corner accessories, as shown and described.
Figure 7:
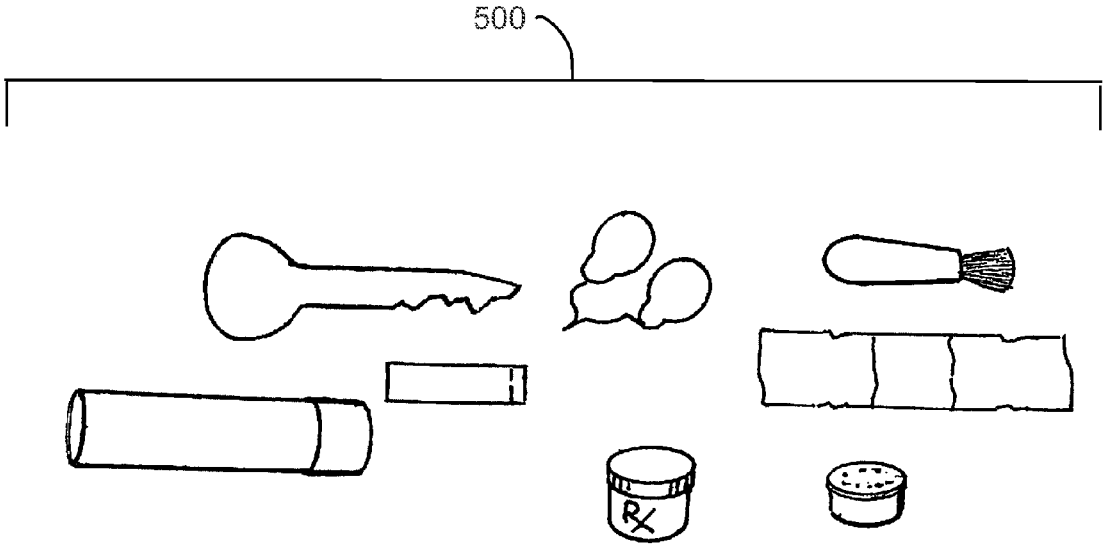
FIG. 7 is a side view of a selection of items, according to the present invention.
Figure 8:
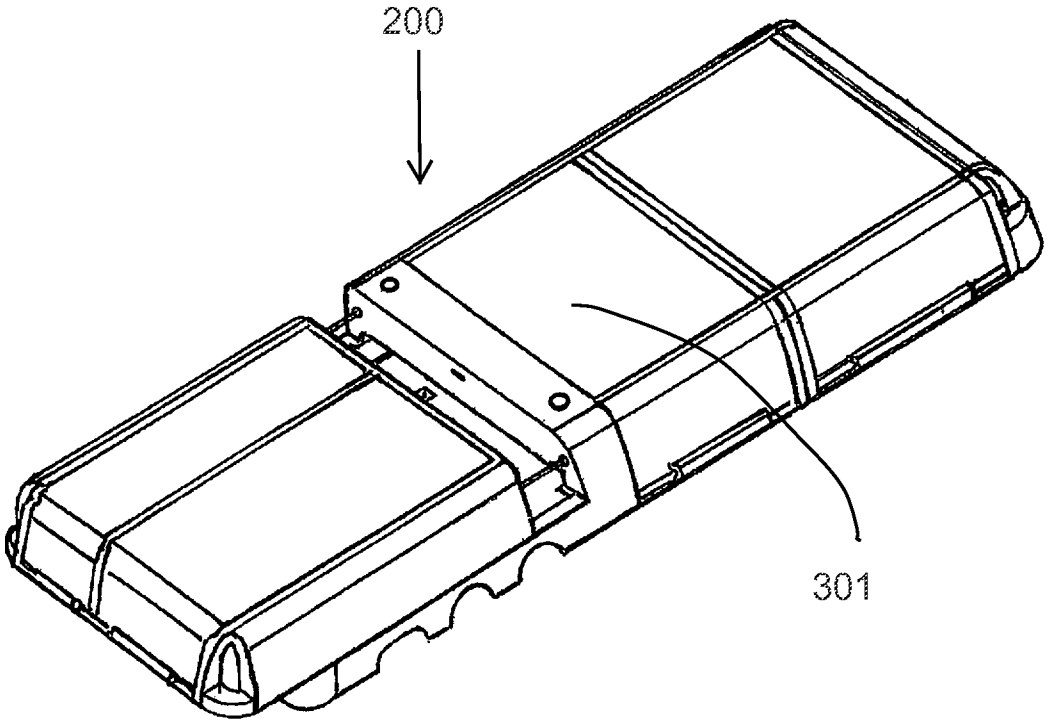
FIG. 8 is an isometric view of the device with the storage compartment oriented in a horizontal direction, according to the present invention.
Figure 9:
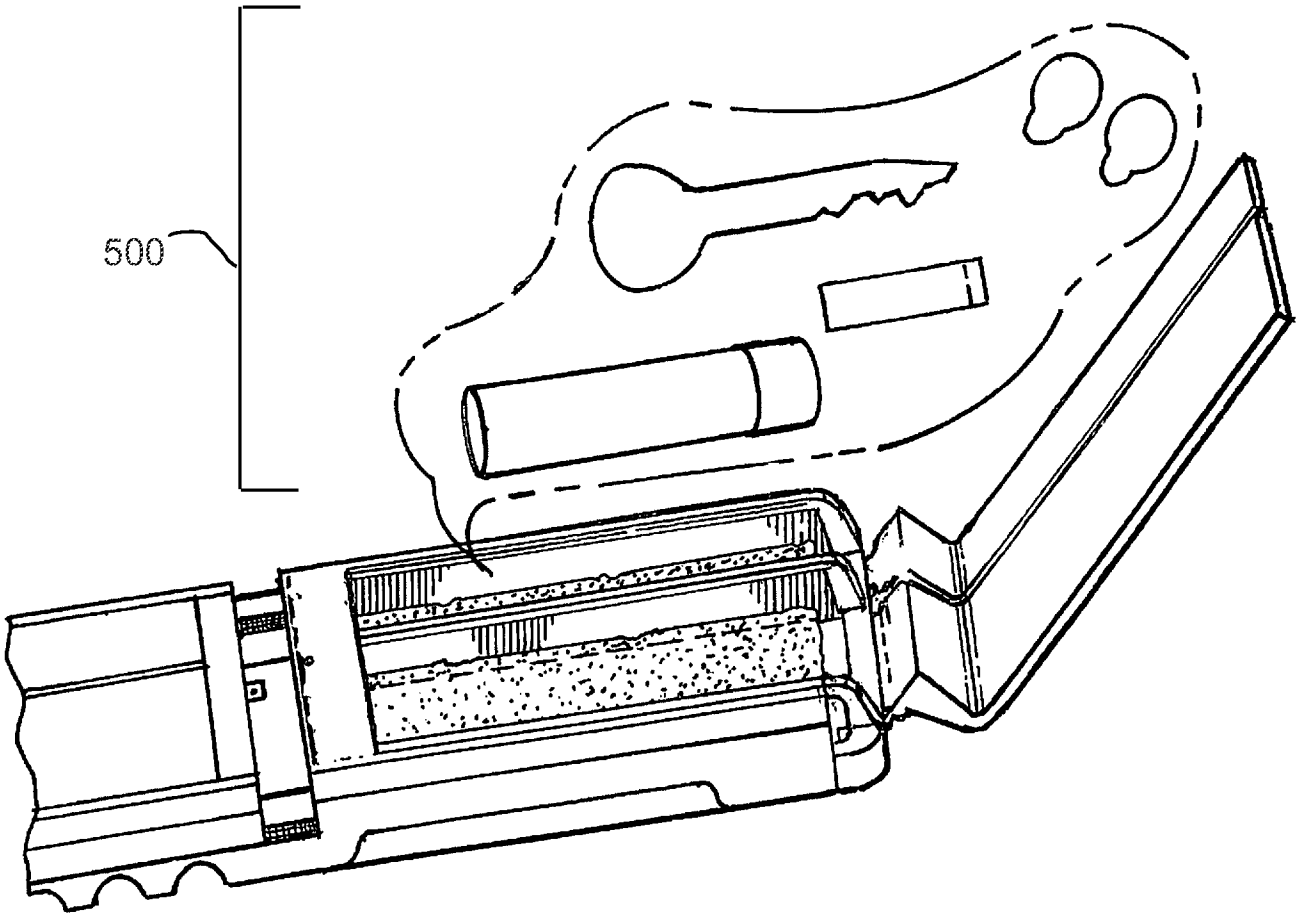
FIG. 9 is an isometric view of items received within a storage compartment, according to the present invention.

Preferably, the upper part 220 is hingedly secured to the lower part 230 using an elastomeric band 600 retained in the lower part 230 and the bottom edge 223. The elastomeric band 600 is preferred as it allows the upper part 220 to be separated from the lower back portion 230 and flipped nearly 180 degrees against the lower back portion, as seen in FIG. 3. The floor 227 will retain objects within the storage compartments 301 during this movement. The removable upper part 220 allows the user of the device to have a protective case 10 allowing for unobscured use of the camera 21 located on the back of the portable electronic device 20.

In a further embodiment of the securing means between the upper part 220 and the lower part 230, the tab 225 and raised detent 226 may be incorporated into the elastomeric band 600. Wherein, the tab 225 forms a sleeve around the elastomeric band 600 and is received within an aperture contiguous with the connection of the elastomeric band 600 to the lower part 230 and the bottom edge 223.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) but that the invention will include all embodiments falling with the scope of the appended claims.

What is claimed is:

1. A protective case for a portable electronic device, the portable electronic device including a front with a display and a user input, a back with a camera lens and camera components, left and right sides, and top and bottom ends, the protective case comprising:

a. a front portion for enclosing the front of the portable electronic device, the front portion exposing the display and user input;

b. a back portion enclosing the back of the portable electronic device, the back portion comprising:

i. an upper part, the upper part repositionable between an open position and a closed position and having a top edge, a bottom edge, a left edge, a right edge, and a floor, the upper part configured to protect the camera lens and camera components when in the closed position and to allow the lens and camera components to capture unobscured images and sound when in the open position; and ii a lower part, the lower part forming the remainder of the back portion;

c. a left side portion and a right side portion for partially enclosing the left side and the right side of the portable electronic device, respectively, the left and right side portions extending between and attaching the front portion to the back portion;

d. a top end portion and a bottom end portion for partially enclosing the top and bottom ends of the portable electronic device, respectively, the top and bottom end portions extending between and attaching the front portion to the back portion;

e. a first corner being located at a junction of the top end portion and the right side portion;

f. a second corner being located at a junction of top end portion and the left side portion;

g. a third corner being located at a junction of the bottom end portion and the left side portion;

h. a fourth corner being located at a junction of the bottom end portion and the right side portion; and i. at least one storage compartment integrated within the upper part of the back portion of the protective case.

2. The protective case of claim 1, wherein the storage compartment is rectangular and selected from the following dimensions:

a depth ranging between 1 mm and 60 mm, a width ranging between 1 mm and 300 mm, and a length ranging between 1 mm and 300 mm.

3. The protective case of claim 2, wherein the left edge of the upper part is in physical communication with the left side portion of the protective case, the right edge of the upper part is in physical communication with the right side portion of the protective case, the top edge of the upper part is in physical communication with the top end portion of the protective case, and the bottom edge of the upper part is in physical communication with the lower part of the back portion of the protective case.

4. The protective case of claim 2, wherein the storage compartment contains one or more items, the items including: a tool, a tweezers, a toothpick, a lens cleaning cloth, a kickstand to prop the portable electronic device for viewing, a set of earphones, a telephonic head/speaker set, a flash drive, a laser pointer, a health monitoring item, a medical item, an office product, a cosmetic product, a pharmaceutical product, a candy product, a hygiene product, a spice, a sweetener, a condiment, a cleaning product, a writing instrument, an adhesive product, a mount, a safety product, a first aid product, a survival product, a oral care product, a pair of eye glasses, a battery, a charger, a stylus, a screwdriver, a cosmetic applicator, and a cable.

5. The protective case of claim 4, wherein the storage compartment includes a mat to frictionally secure the items within the storage compartment.

6. The protective case of claim 5, wherein the thickness of the mat is compressible and selected to correspond to the depth of the storage compartment less the thickness of the items, wherein the thickness of the mat is used to securely retain items of varying thickness within the storage compartment.

7. The protective case of claim 1, wherein the bottom edge of the upper part has at least one tab with a raised detent for removable receipt within at least one slot on the lower part.

8. The protective case of claim 1, wherein a corner storage compartment is located in at least one of the four corners of the protective case and a removable corner accessory is slideably retained in the corner storage compartment, the corner accessory comprising:

a. a body having a length for receipt with the corner storage compartment;

b. a head being attached to an end of the body; and c. the head being shaped and sized to form the corner of the protective case when the corner accessory is slideably retained in the corner storage compartment.

9. A protective case for a portable electronic device, the portable electronic device including a front with a display and a user input, a back with a camera lens and camera components, left and right sides, and top and bottom ends, the protective case comprising:

a. a front portion for enclosing the front of the portable electronic device, the front portion exposing the display and user input;

b. a back portion enclosing the back of the portable electronic device, the back portion comprising:

i. an upper part, the upper part removable and having a top edge, a bottom edge, a left edge, a right edge, and a floor, the upper part configured to protect the camera lens and camera components and to allow the lens to capture unobscured images and sound when removed, and ii. a lower part, the lower part forming the remainder of the back portion;

c. a left side portion and a right side portion for partially enclosing the left side and the right side of the portable electronic device, respectively, the left and right side portions extending between and attaching the front portion to the back portion;

d. a top end portion and a bottom end portion for partially enclosing the top and bottom ends of the portable electronic device, respectively, the top and bottom end portions extending between and attaching the front portion to the back portion;

e. a first corner being located at a junction of the top end portion and the right side portion;

f. a second corner being located at a junction of the top end portion and the left side portion;

g. a third corner being located at a junction of the bottom end portion and the left side portion;

h. a fourth corner being located at a junction of the bottom end portion and the right side portion;

i. a corner storage compartment located in at least the first or second corner of the protective case in the upper part of the back portion of the case; and j. a removeable corner accessory slideably retained in the corner storage compartment, the corner accessory comprising:

i. a body having a length for receipt with the corner storage compartment, ii. a head being attached to an end of the body, and iii. the head being shaped and sized to form the corner of the protective case when the corner accessory is slideably retained in the corner storage compartment.

10. The protective case of claim 9, further comprising a plurality of storage compartments integrated within the back portion of the protective case, wherein at least one of the plurality of storage compartments is integrated within the upper part of the back portion of the protective case.

11. The protective case of claim 1, wherein the upper part is repositionable using a hinge.

12. The protective case of claim 1, wherein the upper part is removably attached to the lower part.

* * * * *